US009206027B2

(12) United States Patent
Hauser

(10) Patent No.: US 9,206,027 B2
(45) Date of Patent: Dec. 8, 2015

(54) MOUNTABLE CORK PULLER

(75) Inventor: James Brian Hauser, Clinton, WA (US)

(73) Assignee: B/E Aerospace, Inc., Wellington, FL (US)

( * ) Notice: Subject to any disclaimer, the term of this patent is extended or adjusted under 35 U.S.C. 154(b) by 841 days.

(21) Appl. No.: 13/410,710

(22) Filed: Mar. 2, 2012

(65) Prior Publication Data

US 2012/0222520 A1 Sep. 6, 2012

Related U.S. Application Data

(60) Provisional application No. 61/449,122, filed on Mar. 4, 2011.

(51) Int. Cl.
*B67B 7/04* (2006.01)

(52) U.S. Cl.
CPC ..... *B67B 7/0452* (2013.01)

(58) Field of Classification Search
CPC ..... B67B 7/0452
USPC ..... 81/3.09, 3.25, 3.3
See application file for complete search history.

(56) References Cited

U.S. PATENT DOCUMENTS

| | | | | | |
|---|---|---|---|---|---|
| 1,728,787 | A | * | 9/1929 | De Bracht | 81/3.09 |
| 1,763,849 | A | * | 6/1930 | Hoegger | 81/3.09 |
| 1,775,164 | A | * | 9/1930 | Hoegger | 81/3.25 |
| 1,975,606 | A | * | 10/1934 | Hoegger | 81/3.09 |
| 2,576,800 | A | * | 11/1951 | Menderman | 81/3.27 |
| 2,933,957 | A | * | 4/1960 | Wendlandt | 81/3.27 |
| 3,727,247 | A | * | 4/1973 | Miller | 7/152 |
| 4,154,127 | A | * | 5/1979 | Russo | 81/3.25 |
| 4,590,821 | A | * | 5/1986 | Olson | 81/3.37 |
| 4,996,895 | A | * | 3/1991 | Brucart Puig | 81/3.09 |
| D336,837 | S | * | 6/1993 | Reed | D8/37 |
| 5,934,160 | A | * | 8/1999 | Gibson | 81/3.37 |
| 6,904,828 | B2 | * | 6/2005 | Kane | 81/3.25 |
| 7,287,446 | B2 | * | 10/2007 | Wrobel et al. | 81/3.37 |
| 2008/0098854 | A1 | | 5/2008 | Goldstein | |

FOREIGN PATENT DOCUMENTS

| | | |
|---|---|---|
| EP | 1772423 A1 | 4/2007 |
| FR | 2734254 A1 | 11/1996 |

OTHER PUBLICATIONS

International Search Report PCT/US2012/027416 dated Jun. 4, 2012.

* cited by examiner

*Primary Examiner* — Hadi Shakeri
*Assistant Examiner* — Danny Hong
(74) *Attorney, Agent, or Firm* — Shumaker, Loop & Kendrick, LLP

(57) ABSTRACT

A mountable cork puller including a tray open on one major side thereof adapted to be mounted in a recess in a wall, a hinge pin associated with the tray, and a hinge pivotally carried on the hinge pin, the hinge attached at its free end to a cork puller such that the hinge swings the cork puller between a stowed position in the tray and a deployed use position removed from the tray.

17 Claims, 7 Drawing Sheets

MOUNTABLE CORK PULLER

CROSS-REFERENCE TO RELATED APPLICATION

This application claims priority to U.S. Provisional Application No. 61/449,122 filed Mar. 4, 2011, the contents of which are incorporated by reference herein.

TECHNICAL FIELD AND BACKGROUND OF THE INVENTION

The present invention relates generally to the field of mountable kitchen utensils such as for use in an aircraft galley, and more particularly, to a cork puller mounted on a support configured to move the cork puller between a compact stowed position and a deployed use position.

Aircraft and other moving conveyances having galleys typically include unique utensil designs and ways of storing utensils that best utilize the limited space available and prevent shifting during movement. With regard to aircraft galleys and other conveyances used for commercial passengers, it is also desirable to fix utensils in place so that they are easily located and to prevent loss. With regard to aircraft in particular, it is also desirable to mount potentially dangerous items (e.g., sharp items) in place so that they cannot be used as weapons.

One such utensil commonly found in a galley, such as an aircraft galley, is a cork puller. Cork pullers typically include a helical coil made of metal that terminates in a sharp point that is screwed into a cork and pulled upward to remove the cork from a bottle, such as a wine bottle. Conventional cork pullers are typically loose, hand-held utensils stored in a drawer between uses. Because cork pullers may be used multiple times during each flight, and because cork pullers can potentially be used as weapons, it would be desirable to provide a cork puller that is fixed in a convenient location to prevent loss and its use as a weapon. It would further be desirable to provide a cork puller that mounts within a galley in a manner that is convenient for use and makes efficient use of limited space.

BRIEF SUMMARY OF THE INVENTION

In one aspect, a mountable cork puller is provided herein.

In another aspect, the mountable a cork puller is configured to be mounted recessed within a support wall, such as a galley wall, cabinet or bulkhead.

In another aspect, the cork puller is movable between a stowed position within a tray to a deployed use position forward of the support wall.

In another aspect, the mountable cork puller is generally flush with the support wall when in the stowed position.

In another aspect, the cork puller is fixed to a movable support such that the cork puller is prevented from being removed from the support in either the stowed or deployed use positions.

In another aspect, the cork puller is operable with one hand, leaving the other hand free to hold the bottle.

To achieve the foregoing and other aspects and advantages, in one embodiment a mountable cork puller is provided herein including a tray open on one major side thereof adapted to be mounted in a recess in a wall, a hinge pin associated with the tray, and a hinge pivotally carried on the hinge pin, the hinge attached at its free end to a cork puller such that the hinge swings the cork puller between a stowed position in which the cork puller is stowed in the tray and a deployed use position in which the cork puller is removed from the tray.

The hinge pin may be angled with respect to vertical such that the cork puller is raised as it swings in the direction of the deployed use position.

The hinge may define an opening therethrough for receiving a finger for moving the hinge, and the tray may include a flange extending in the direction of the one open major side behind which the hinge sits in the stowed position, and which the hinge is raised to clear to move the cork puller from the stowed position to the deployed use position.

The hinge may be angled such that the cork puller can be swung about 180 degrees between the stowed and deployed use positions.

The tray may include flanges that extend horizontally outwardly from the one open major side that overlap the wall.

The cork puller may include a handle pivotally connected to the hinge, a screw connected to the handle, and a screw housing pivotally connected to the hinge, wherein the handle is lowered with respect to the hinge to drive the screw into a cork in a bottle, and is raised with respect to the hinge to withdraw the cork from the bottle. The screw housing may include a bottle neck positioning collar.

The cork puller mounts flush with the wall when the cork puller is in the stowed position, and is positioned forward with respect to the wall when the cork puller is in the deployed use position.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

The mountable cork puller disclosed herein is configured to be mounted on a support wall such as a bulkhead, galley cabinet or other support wall. Although the mountable cork puller is described herein as being mounted to a support wall in an aircraft galley, the mountable cork puller is suitable for being mounted to any support structure, such as in a home, restaurant kitchen, bar or any other facility where corked bottles are opened. Mounting the cork puller on a support wall allows the cork puller to be stowed away when not in use, provides a means of holding the cork puller during use, frees one hand for holding the bottle, fixes the cork puller to the wall and prevents loss of the cork puller, among other advantages.

As used herein, the term "cork puller" in intended to broadly describe any device for drawing a cork or stopper from a bottle or other container. Although most cork pullers include a helical coil terminating in a sharp point that is turned to advance into a cork, other types of cork pullers may be used with this invention. Although the cork puller shown and described herein includes a specific handle and screw configuration, it is envisioned that the shapes and configurations may be changed without departing from the spirit and scope of the invention. For example, alternative cork puller configurations may include twist-type T-bar handles, press levers, wing gears and twin-prong cork pullers, among others.

Figure 1:
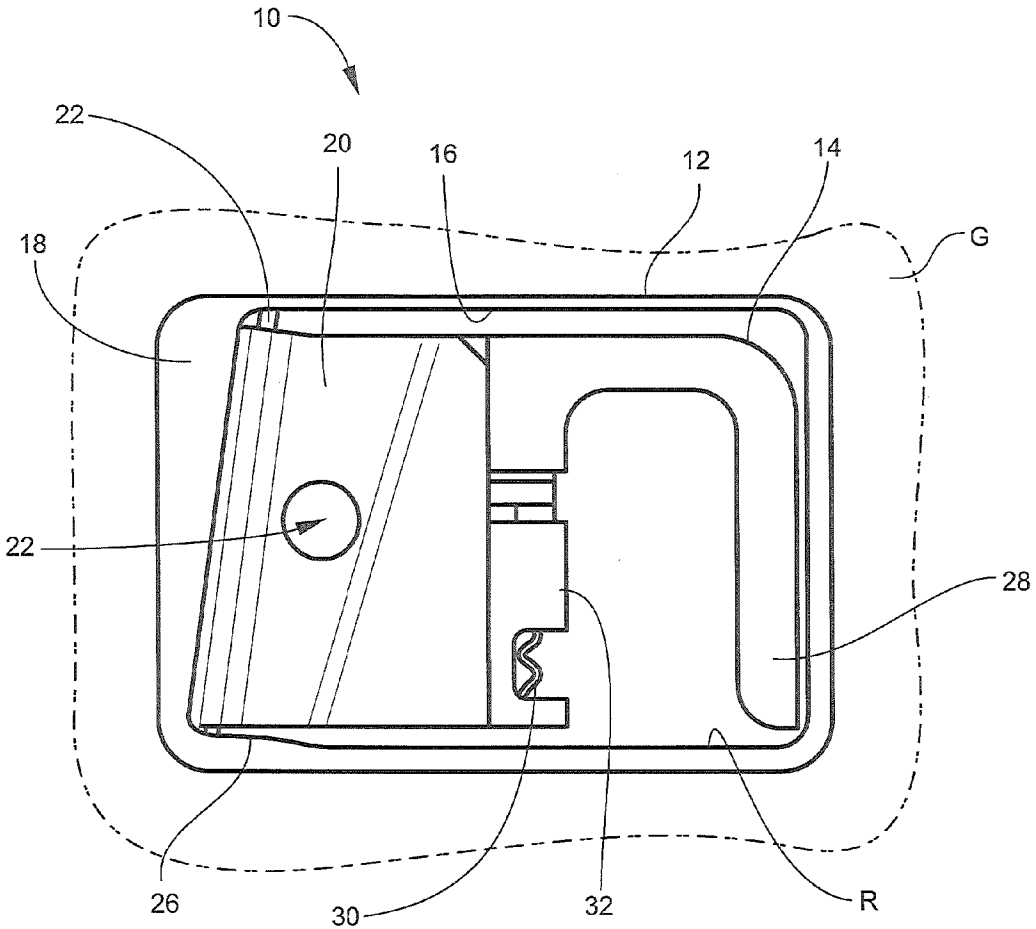
FIG. 1 is a side elevation view of an embodiment of a mountable cork puller shown in a stowed position.
Figure 2:
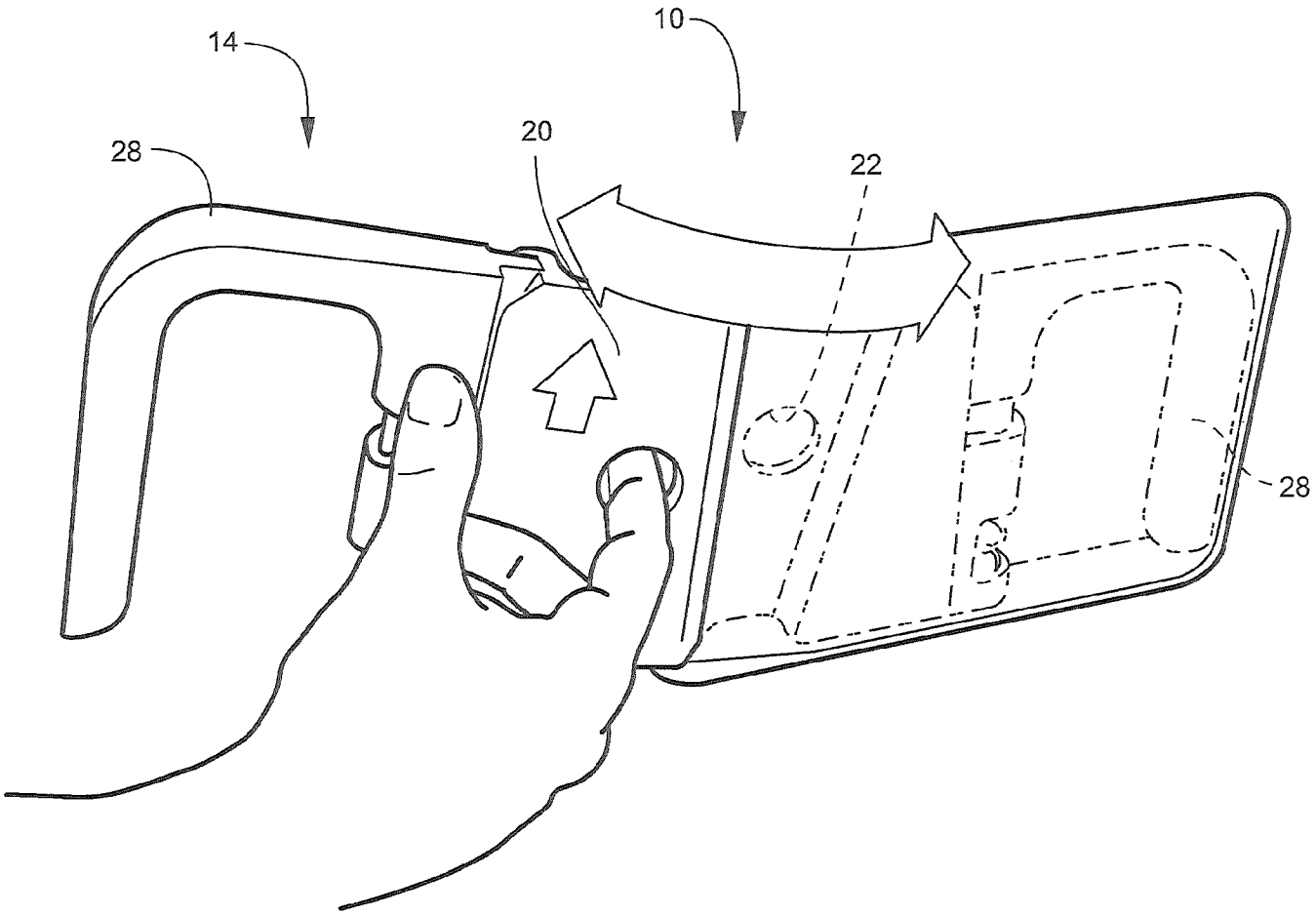
FIG. 2 is a side elevation view of the cork puller shown deployed for use and indicating the motion sequence by which the cork puller is deployed.
Figure 3:
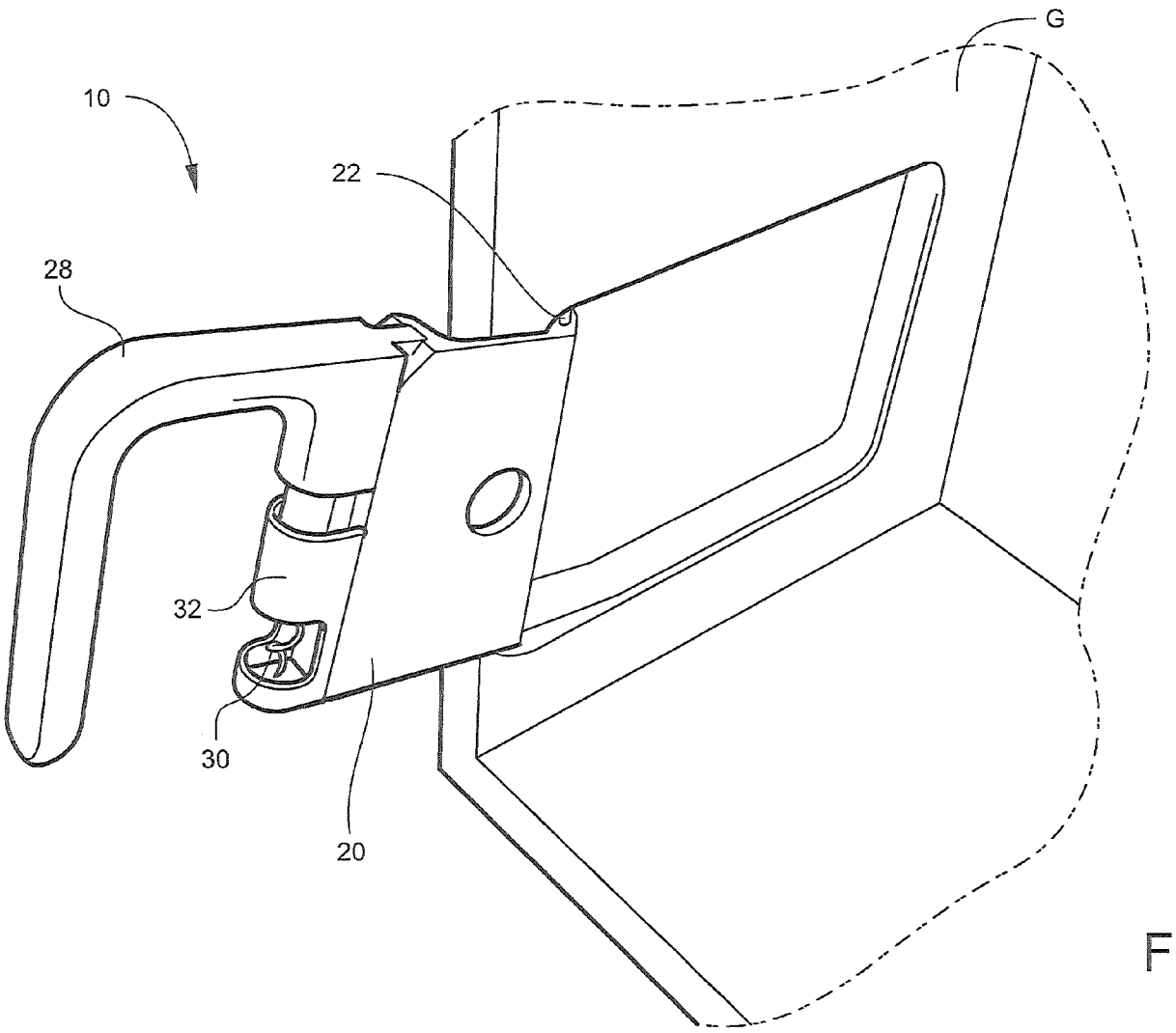
FIG. 3 is a perspective view of a portion of a support wall on which the cork puller is mounted, with the cork puller shown in the deployed use position.

Referring to FIGS. 1-3, a mountable cork puller according to an embodiment of the present invention is shown generally at reference numeral 10. The overall assembly in its stowed position has a thickness substantially less than its length or height, and thus may be mounted recessed within a wall having a small thickness, such as a cabinet or bulkhead. As shown, the assembly is mounted within a recess "R" in a galley wall "G" sufficiently deep to fully contain the thickness dimension of the assembly. In the stowed position, the assembly sits substantially flush with the support wall.

The assembly includes a generally rectangular-shaped tray 12 that is open on one major side thereof for housing a movable cork puller 14 between uses. The tray 12 has a depth substantially corresponding to the thickness of the cork puller 14 such that the cork puller can be stowed entirely within the tray between uses. The shape of the tray 12 and the dimensions thereof may be sized and shaped to correspond to the shape of the cork puller 14. The tray 12 has sidewalls 16 that extend "upwardly" from the bottom that define the depth of the tray. The tray 12 further includes horizontal flanges 18 that extend perpendicularly outwardly from the sidewalls that overlap the galley wall G. The tray 12 may be secured to/within the galley wall G using fasteners, adhesive, etc.

The assembly further includes a swinging hinge 20 mounted on a hinge pin 22 for moving the cork puller 14 between its stowed and deployed use positions. The hinge 20 is a substantially planar member, for example constructed of aluminum, that is attached at its free end to the cork puller 14. As shown, the hinge pin 22 is received through openings in the top and bottom sidewalls of the tray and is angled slightly with respect to vertical. The angle of the hinge pin 22 causes the cork puller 14 to raise and angle slightly upward as it moves toward its deployed use position.

The hinge 20 defines a finger hole 24 therethrough for moving the cork puller 14 between its stowed and deployed use positions. The hinge 20 may be locked in place in the stowed position by a flange 26 that protrudes slightly into the opening of the tray 12. To move the cork puller 14 from its stowed position, the hinge 20 is lifted upward to clear the flange 26 such that the free end of the hinge is free to swing outward. As shown, clearance is provided between the top of the tray 12 and the top sidewall 16 for lifting the hinge 20 within the tray. The hinge 20 may further be angled slightly such that the cork puller 14 is full to swing about a full 180 degrees between its stowed and deployed use positions, as shown in FIG. 2. In the deployed use position, the angled mounting pin 22 deploys the cork puller 14 at an upward, ergonomic angle comfortable for use.

The cork puller 14 mounts to the free end of the hinge 20 with its handle 28 extending in the direction generally away from the hinge. The screw 30 is coaxial with a screw housing 32 and extends downward.

Figure 4:
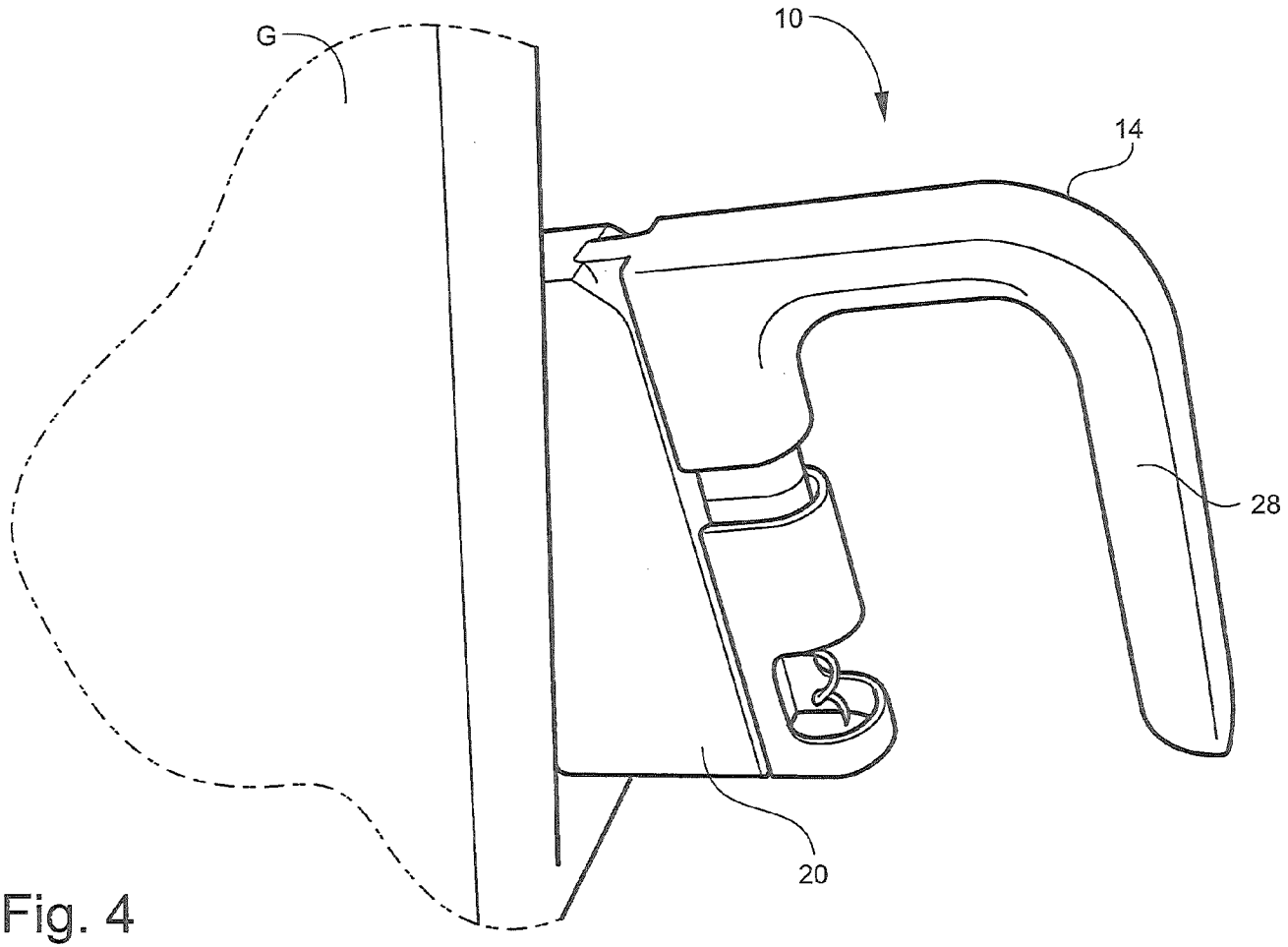
FIG. 4 is a perspective view of the cork puller shown in the deployed use position and extending for of the support wall.

Referring to FIG. 4, the cork puller 14 in the fully deployed position is entirely forward of the galley wall G, thus conveniently positioned for use without obstructions. Because the assembly requires room to swing between the stowed and deployed use positions, the assembly is preferably mounted in a position away from another support wall or from an object in the swinging pathway of the cork puller 14.

Figure 5:
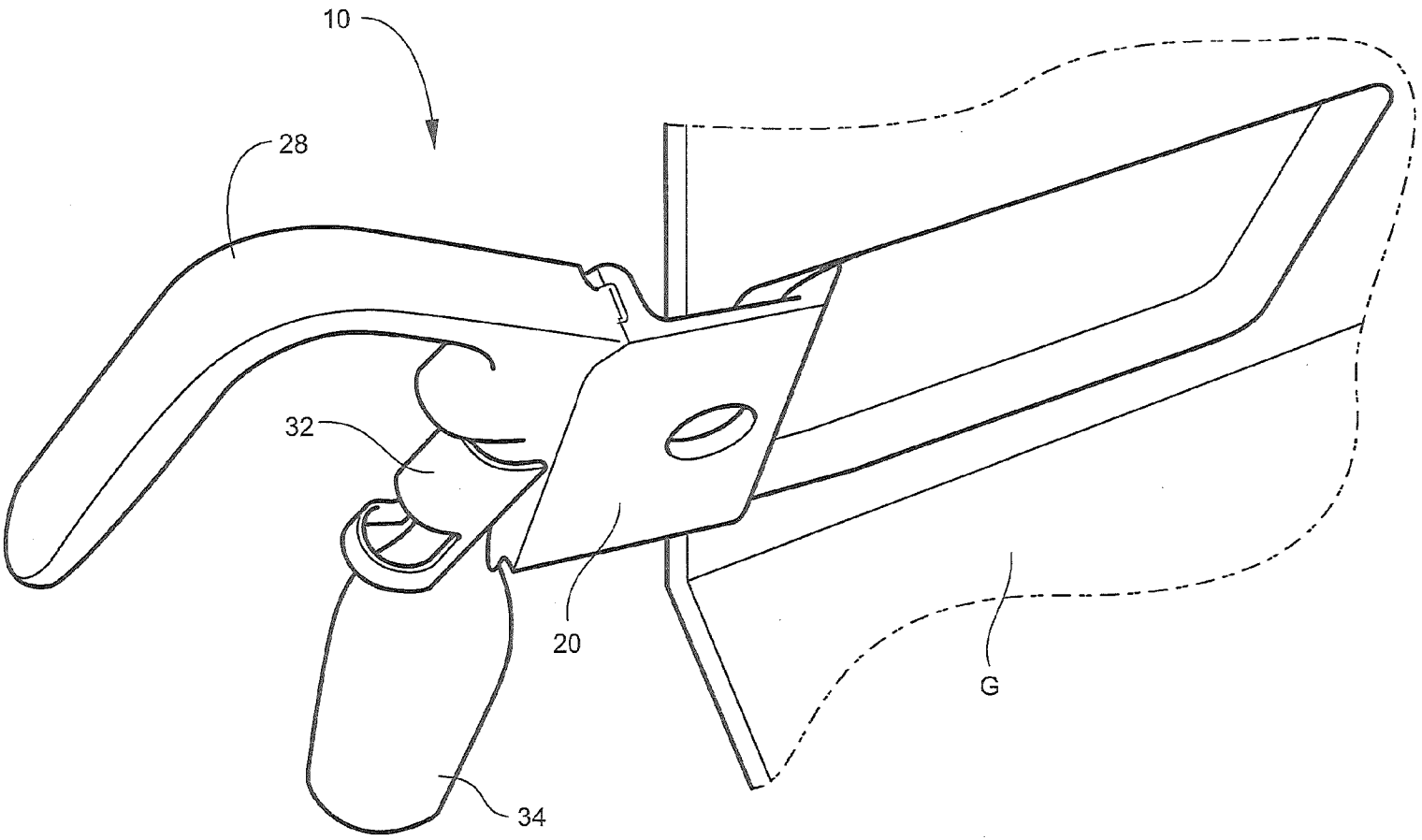
FIG. 5 is a perspective view of the cork puller shown ready to engage a cork in a bottle.

Referring to FIG. 5, the handle 28 is pivotally attached to the hinge 20 such that the handle can be raised and lowered to move the screw 28 away from the hinge 20 for access. The screw housing 32, which also serves as a bottle neck positioning collar, is pivotally attached to the cork puller 14 and thus can be swung upward to receive the neck of the bottle 34. The screw housing 32 may pivot independent of the pivoting movement of the handle 28.

Figure 6:
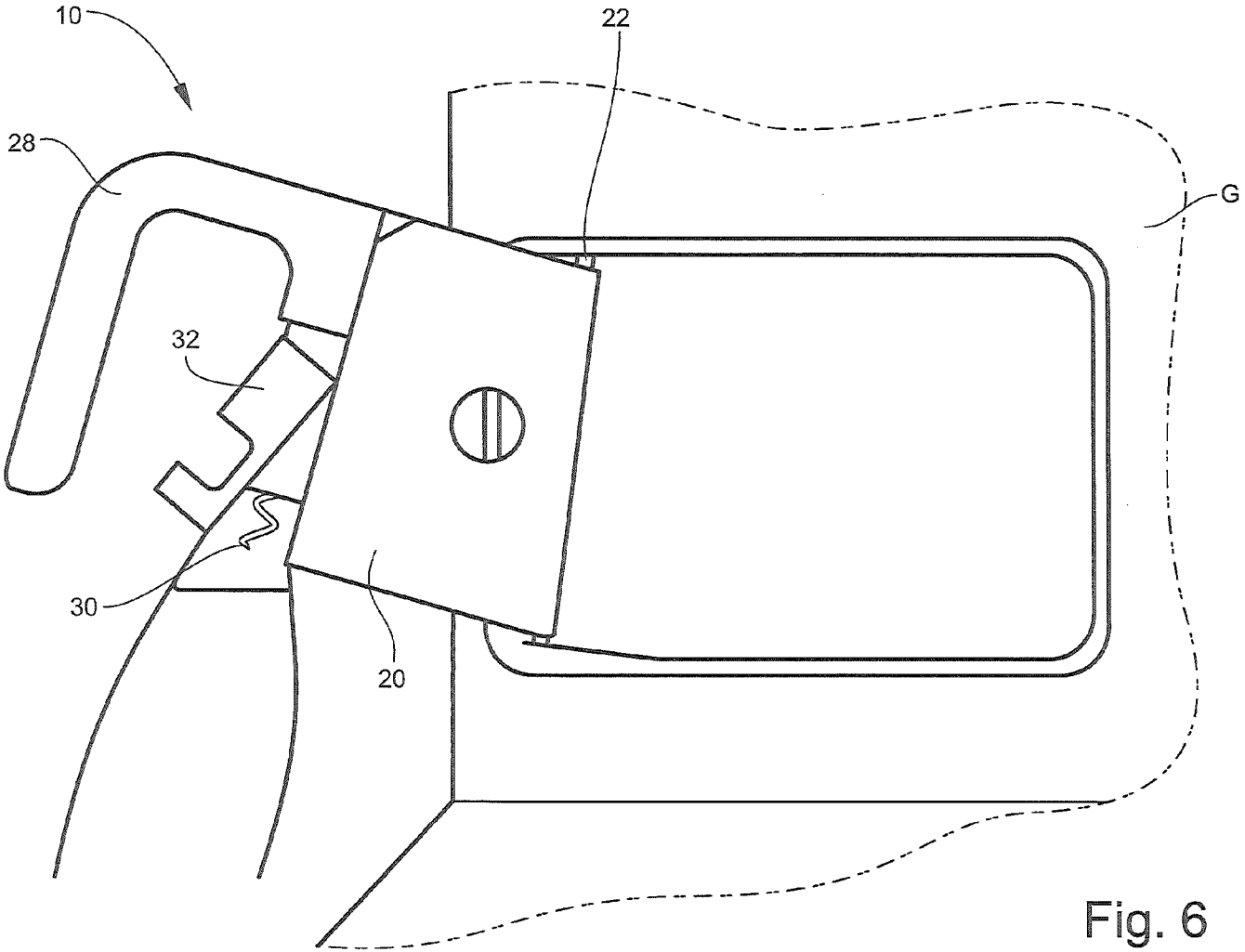
FIG. 6 is a side elevation view of the cork puller shown ready to engage a cork in a bottle.
Figure 7:
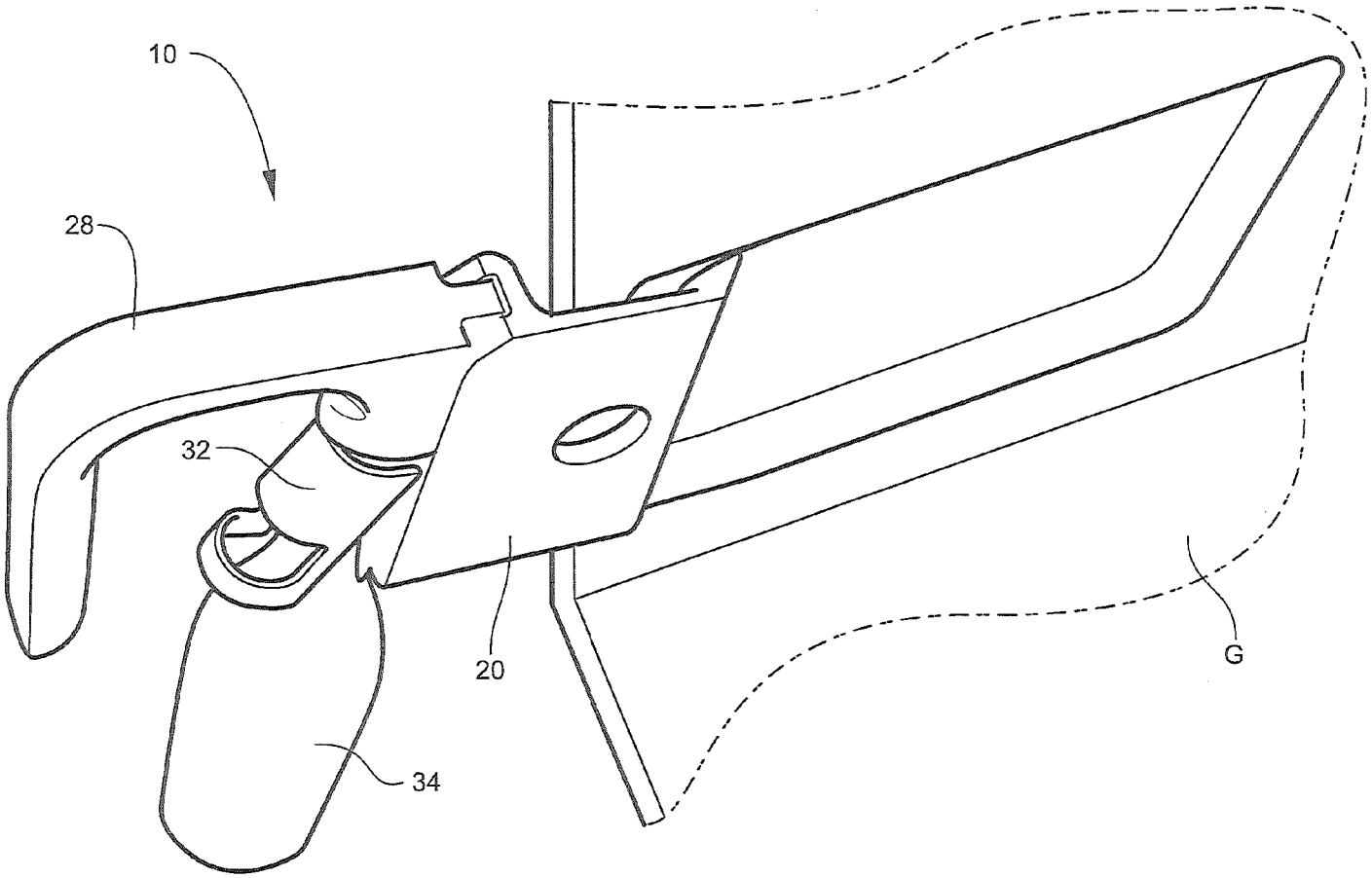
FIG. 7 is a top perspective view of the cork puller shown engaged with a cork in a bottle.

To remove a cork, the handle 28 is lifted and the neck of the bottle 34 is inserted under the screw housing 32, which tilts out slightly to accommodate the neck of the bottle, and is held in the correct position in relation to the screw 28 by the housing. As shown in FIG. 6, the handle 28 is depressed into the shown position, driving the screw 28 into the cork. The same position from a different view is shown in FIG. 7. To remove the cork, the handle 28 is lifted and the mouth of the bottle 34 is forced against the screw housing 32. As the handle 28 is lifted further, the cork is removed from the bottle 34.

The cork puller 14 is therefore conveniently available for use, protected against pilferage, misuse or loss. The assembly is easily installed as a retrofit item in an existing fixture, or can be factory-installed for original equipment installation. The assembly is particularly convenient and space-saving in environments where space is at a premium.

The foregoing description provides embodiments of the invention by way of example only. It is envisioned that other embodiments may perform similar functions and/or achieve similar results. Any and all such equivalent embodiments and examples are within the spirit and scope of the present invention and are intended to be covered by the appended claims.

What is claimed is:

1. A mountable cork puller, comprising:

a tray open on one major side thereof adapted to be mounted in a recess in a wall;

a hinge pin mounted within the tray;

a hinge pivotally carried on the hinge pin, the hinge fixed at an end thereof opposite the hinge pin to a cork puller such that the hinge swings the cork puller between a stowed position in which the cork puller is stowed in the tray and a deployed use position in which the cork puller is removed from the tray; and a flange extending across a portion of the tray, the flange retaining the hinge in the tray in the stowed position, and in which the hinge is axially raised along the hinge pin to clear the flange to pivotally deploy the hinge from the tray perpendicular to said hinge.

2. The mountable cork puller according to claim 1, wherein the hinge pin is angled with respect to vertical such that the cork puller is raised as it swings in the direction of the deployed use position.

3. The mountable cork puller according to claim 1, wherein the hinge defines an opening therethrough for receiving a finger for moving the hinge.

4. The mountable cork puller according to claim 1, wherein the hinge is angled such that the cork puller can be swung 180 degrees between the stowed and deployed use positions.

5. The mountable cork puller according to claim 1, wherein the tray further comprises laterally extending flanges arranged to overlap a wall in which the tray is mounted.

6. The mountable cork puller according to claim 1, wherein the cork puller comprises:

a handle pivotally connected to the hinge;

a screw connected to the handle; and a screw housing pivotally connected to the hinge;

wherein the handle is lowered with respect to the hinge to drive the screw into a cork in a bottle, and is raised with respect to the hinge to withdraw the cork from the bottle.

7. The mountable cork puller according to claim 6, wherein the screw housing includes a bottle neck positioning collar.

8. The mountable cork puller according to claim 1, wherein the cork puller is flush with the wall when the cork puller is in the stowed position.

9. The mountable cork puller according to claim 1, wherein the cork puller is positioned forward with respect to the wall when the cork puller is in the deployed use position.

10. A mountable cork puller for being mounted within a recess in a face of a wall in an aircraft galley, comprising:

a tray open on one major side thereof adapted to be mounted in the recess;

a hinge pin mounted within the tray; and a hinge pivotally carried on the hinge pin, the hinge fixed at an end thereof opposite the hinge pin to a cork puller such that the hinge is adapted to swing the cork puller between a stowed position in which the cork puller is stowed in the tray and flush with the face of the wall, and a deployed use position in which the cork puller is positioned forward of the wall; and a flange extending across a portion of the tray, the flange retaining the hinge in the tray in the stowed position, and in which the hinge is axially raised along the hinge pin to clear the flange to pivotally deploy the hinge from the tray perpendicular to said hinge.

11. The mountable cork puller according to claim 10, wherein the hinge pin is angled with respect to vertical such that the cork puller is raised as it swings in the direction of the deployed use position.

12. The mountable cork puller according to claim 10, wherein the hinge defines an opening therethrough for receiving a finger for moving the hinge.

13. The mountable cork puller according to claim 10, wherein the hinge is angled such that the cork puller can be swung 180 degrees between the stowed and deployed use positions.

14. The mountable cork puller according to claim 10, wherein the tray further comprises laterally extending flanges arranged to overlap the wall.

15. The mountable cork puller according to claim 10, wherein the cork puller comprises:

a handle pivotally connected to the hinge; a screw connected to the handle; and a screw housing pivotally connected to the hinge;

wherein the handle is lowered with respect to the hinge to drive the screw into a cork in a bottle, and is raised with respect to the hinge to withdraw the cork from the bottle.

16. The mountable cork puller according to claim 15, wherein the screw housing includes a bottle neck positioning collar.

17. The mountable cork puller according to claim 10, wherein the cork puller is fixed to the hinge such that the cork puller is prevented from being removed from the hinge in either the stowed of deployed use positions.

* * * * *